United States Patent [19]

Bills

[11] 4,188,853

[45] Feb. 19, 1980

[54] MULTIPURPOSE DOUBLE ACTING DRUM PEDAL

[76] Inventor: John E. Bills, 7914 Shoals Dr., Apt. C, Orlando, Fla. 32807

[21] Appl. No.: 858,608

[22] Filed: Dec. 8, 1977

[51] Int. Cl.[2] ..... G10D 13/02

[52] U.S. Cl. ..... 84/422 R

[58] Field of Search ..... 84/422 R

[56] References Cited

U.S. PATENT DOCUMENTS

| | | | |
|---|---|---|---|
| 1,508,390 | 9/1924 | Gladstone | 84/422 |
| 2,484,302 | 10/1949 | Laverents | 84/422 |
| 2,658,421 | 11/1953 | Clayton | 84/422 |
| 3,618,441 | 11/1971 | Fearns | 84/422 |
| 3,968,718 | 7/1976 | Carver | 84/422 |

*Primary Examiner*—L. T. Hix
*Assistant Examiner*—S. D. Schreyer
*Attorney, Agent, or Firm*—Julian C. Renfro

[57] ABSTRACT

A double acting drum beater device is provided having a beater adapted to strike an adjacent drumhead once for each downward movement of a foot operated pedal, and then a second time during the subsequent upward movement of the pedal. My drum beater device comprises a beater arm arranged to swing in an arc about a rotatable axis defined by a shaft supported by mounting means, which shaft is arranged to undertake oscillatory type movements. A foot pedal having up and down operative movements is mounted adjacent the mounting means and linkage means connects a toe portion of the foot pedal to an arm secured to the shaft in an offset relation. In this way, up and down movements of the toe portion of the pedal cause the connecting linkage and the arm to move responsively and thus cause the shaft to oscillate, with the shaft rotating in a first direction and then in the opposite direction about its longitudinal axis during downward movement of the pedal. Advantageously, the relationship between pedal, linkage, and beater are such that the beater is caused by such shaft oscillations to strike an adjacent drumhead twice for each up-down cycle of the pedal. This basic teaching readily lends itself to incorporation into a double beater arrangement in which a pair of beaters strike an associated drumhead in offset relation.

33 Claims, 11 Drawing Figures

MULTIPURPOSE DOUBLE ACTING DRUM PEDAL

BACKGROUND OF THE INVENTION

In the past, a number of foot-actuated drumbeaters have been proposed, with some of these offering somewhat unusual advantages, such as selectable strokes, the opportunity to hit more than one drum simultaneously, and the like. Perhaps the most pertinent prior art teaching is the Fearns U.S. Pat. No. 3,618,441 wherein the patentee claims to have a Double Acting Drum Pedal. However, his rocking pedal has positive control over the movement of his beater shaft only in a single direction, and he must necessarily rely upon a spring to cause the return of his drumbeater to a neutral position. Inasmuch as Fearns uses a flexible leather strip to form the connection between a toe portion of his foot pedal and the beater arm, this necessarily precludes the application by the drummer of a considerable amount of power in both operative directions of his beater.

It also should be noted that foot pedals of the Fearns type entail an uncomfortable, unrealistic foot movement, for his rockable pedal requires a centralized pivot point if sufficient force for beater operation is to be developed.

To be contrasted with all of the known prior art is now a beater arrangement in which the foot pedal at all times positively controls the positioning of the beater or beaters used.

SUMMARY OF THIS INVENTION

In accordance with this invention I have provided a drumbeater device distinctive in many ways over the prior art, and most significantly in that it is double acting. This is to say, my novel device utilizes one or more beaters mounted on a pedal-driven oscillatory shaft such that each beater is caused to strike an adjacent drumhead once for each downward movement of a rockable foot pedal, and then a second time during the subsequent upward movement of the pedal.

My novel arrangement is accomplished by connecting the toe portion of the rockable pedal by means of a novel linkage to the oscillatory shaft, with this linkage being of rigid components such that the drummer has positive and effective control over the positioning of the beater or beaters at all times.

Absent entirely from my novel construction is the spring conventionally utilized for bringing each beater back away from the drumhead and into a neutral position. Rather, the spring utilized in some embodiments of my invention is entirely concerned with causing a return of the pedal to its upward position. As a matter of fact, by utilizing a rockable foot pedal, the drummer is enabled by appropriate heel pressure to compel an upward return of the foot pedal, and this makes entirely optional the use of any return spring in my device.

The capability of my device to cause each beater to strike the associated drumhead twice per up and down cycle of the foot pedal is a principal feature of my invention, but in addition, my novel design readily lends itself to an arrangement in which variations in the relationship between a pair of beaters mounted on the same oscillatory shaft can be brought about.

Particularly interesting arrangements of sound can be accomplished in double beater configurations by placing one beater slightly closer to the drumhead than the other beater, with the beaters thus striking the drumhead in an offset relation, and causing a flam effect.

In accordance with the many variations which can be produced with this invention, one of its principal advantages is versatility. It can be adjusted within fractions of a second by foot operated mechanisms to produce a variety of sounds. It can function as (a) a standard single action bass drum pedal, (b) a drum pedal with a single beater but having double action, (c) a drum pedal having double action with a secondary beater that can be controllably interspersed to complement the sound of the first beater with a sound that is slightly delayed after and having more power than the first, or (d) a drum pedal with or without double action but having a second beater which is locked in position against the drum head to serve as a muffler for the impact of the operative beater.

It should also be noted that the beaters I use are spring mounted, and this makes them capable of producing a sound having more clarity than other drum pedals due to the fact that the beaters are "floating" on springs, quicker on the rebound and absorbing less vibrations through the driving mechanism and support stand.

An even greater advantage of the spring-loaded beaters is their ability to strike the drumhead with a variety of soft and hard impacts while still being able to produce speed and maintain an even tempo. To understand how this is accomplished, it should be observed that when there is a lengthening in the arc or distance between the two beater-operative positions (i.e. the distance of the beater to the drumhead) there is a corresponding increase in the striking power of the beater. The smaller the arc, the lesser the power but greater the speed with which the double acting pedal can be operated. In consideration of this fact, it can be seen how a spring loaded beater, which allows for a lengthening in the arc which the beater will travel when driven by a stronger thrust, can be adjusted for speed at a short distance from the drumhead while still maintaining the ability to strike the drum with harder impacts.

The present invention also makes it possible to alternate between the use of two separate beaters, each having a different texture and producing a different sound.

For example, one beater may be of soft texture and the other a hard texture, and as an additional possibility, if during a performance the drummer wishes to change texture, he may accomplish this without a break in the rhythmic pattern he is keeping.

To this end, and also to enable the operator to alternate between the use of one or two beaters, I provide in accordance with this invention, a laterally operable lever in association with either or both of the beaters, with each such laterally operable lever being operated by an appropriate sideways movement of the drummer's foot. For example, if the beater that is closer to the drumhead at a given instant is soft, and the other beater is of hard texture, the drummer by movement of the appropriate foot-operated lever in the proper direction can cause the beater normally closest to the drumhead to drop out of the action, with thereafter in this instance only the hard beater responding to pedal movements. Then, at the opportune time, the drummer can move that laterally operable lever back to its original position so as to restore the soft beater to an operative condition, but by an appropriate display of skill, the drummer can cause the beaters in effect to exchange positions such that the at-rest position of the hard beater is close to the drumhead, and the soft beater is rearwardly offset therefrom. Other arrangements for changing beater texture entirely by foot movements during a performance will be apparent to those skilled in this art.

It is therefore a principal object of my invention to provide a novel drumbeater device in which each beater of the device is caused to strike an associated drumhead twice for each up-down cycle of the footpedal.

It is another object of my invention to provide a double acting drumbeater device wherein the drummer has positive control over the positions of his beater or beaters at all times, thus making it possible for him to attain more power and more speed during a performance than was possible in accordance with the prior art, wherein beater return movements were accomplished by spring means.

It is still another object of my invention to provide a double acting drumbeater device characterized by its versatility, in that its performance characteristics may be modified very rapidly by certain lateral foot movements, such that a variety of different sounds can be produced on an adjacent drumhead.

It is yet another object of my invention to produce a drumbeater device readily lending itself to one beater of a pair of beaters being placed in an offset relationship to the other, such that first one beater strikes an adjacent drumhead, followed an instant later by the other beater striking the drumhead, with this result being repeated when desired during the upward return stroke of the footpedal.

A particularly important object of my invention is the provision of a drumbeater device utilizing spring-loaded beaters having the ability to strike an adjacent drumhead with a variety of soft and hard impacts while still being able to produce speed and maintain an even tempo. This is accomplished by virtue of the fact that each spring-loaded beater allows for a lengthening of the arc which the beater will travel when driven by a stronger thrust, thereby enabling a drummer to select the intensity of the sound produced.

It is another object of my invention to provide a drumbeater device utilizing one or more beaters capable of producing sounds having more clarity than prior art devices due to the fact that my novel beaters in effect float on springs, therefore being quicker on the rebound and absorbing less vibrations through the driving mechanism and support stand.

Yet still another object of my invention is to provide a drum pedal arrangement wherein either of the beaters may be selectively removed from a position in which it responds to pedal movement, with the operator also being subsequently able to accomplish a restoration of that beater to an active condition, with such being accomplished so as to alternate between the "Flam" affect of two beaters or the use of one beater with double action. This also enables the operator to make a change in beater texture if he so chooses, with the dropping out and the restoration of a beater each being entirely accomplished by lateral foot movements.

It is yet still another object of my invention to provide a rockable type drum pedal arrangement wherein the location of the pivot point of the pedal can be changed readily by the drummer during a performance, such that he can select between power of response and speed of response as the particular performance conditions at a given moment may require.

Other objects, features and advantages of this invention will be more apparent as the description proceeds.

DETAILED DESCRIPTION OF PREFERRED EMBODIMENT

Figure 1:
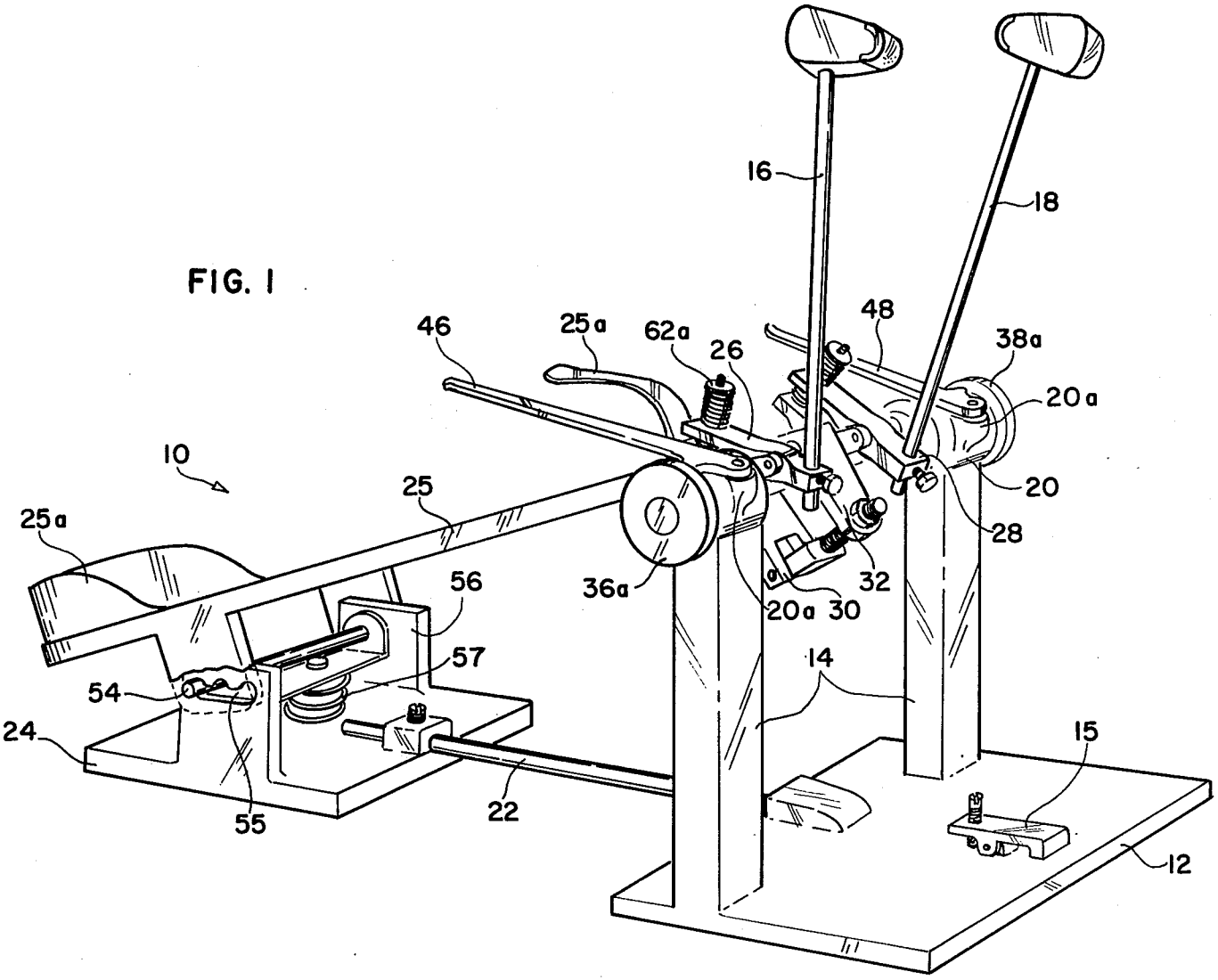
FIG. 1 is a perspective view of a double acting drumbeater arrangement in accordance with my invention, with the beaters in this instance being in a laterally offset relation.

Turning to FIG. 1, it will there be seen that I have provided a drum beater stand 10 in accordance with this arrangement, comprising a base 12, and a pair of upstanding support members 14 that are utilized for supporting a pair of drum beaters 16 and 18. A clamp 15 enables the base to be secured to a drum, preferably a bass drum, although some drummers may find it advantageous to use my novel drumbeater device on a smaller drumhead in order to take full advantage of its versatility and speed. By means of a connection rod 22, the base 12 is connected to a footpedal assembly 24 used to bring about the operation of the beaters 16 and 18. The footpedal assembly 24 can be more or less of standard configuration, being manufactured for example by WFL of Chicago, Ill., but preferably it is of novel construction, having a movable fulcrum arrangement so as to increase the versatility of this arrangement. Such details will be set forth at length hereinafter.

Figure 2A:
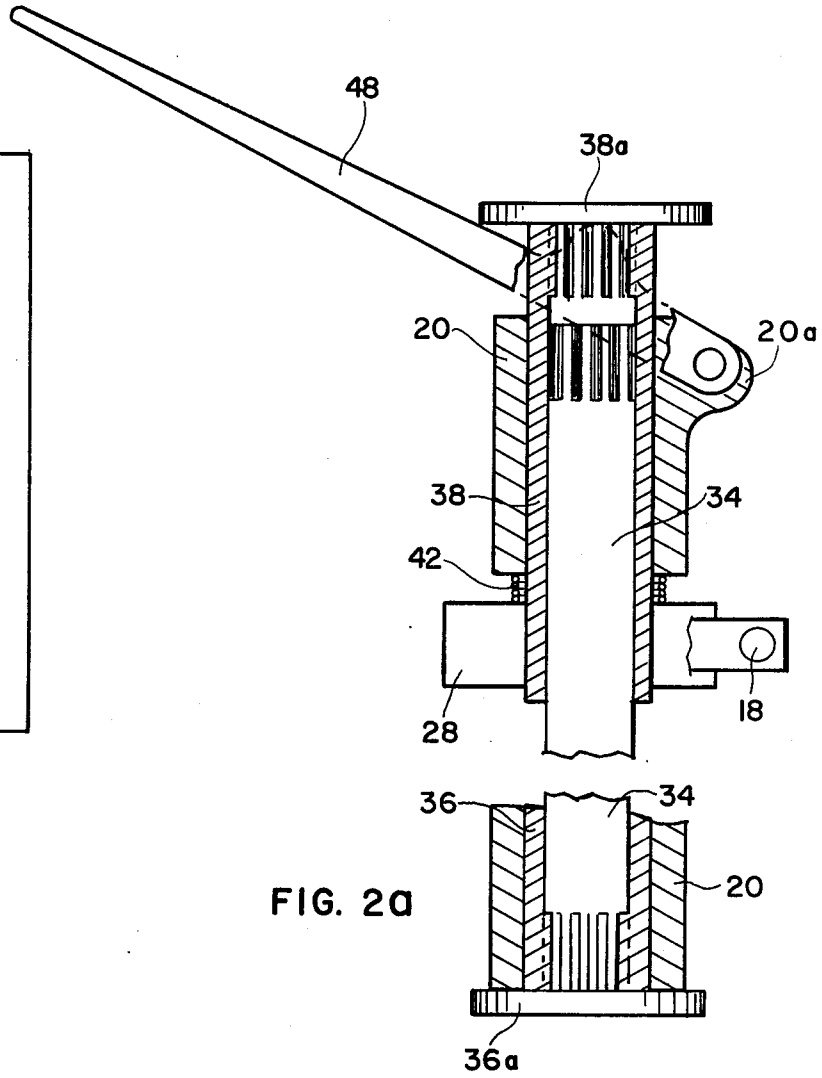
FIG. 2*a* is a cross-sectional view to a slightly larger scale, revealing the arrangement whereby the drummer may accomplish the disconnection of a selected beater by the appropriate lateral foot movement.
Figure 2:
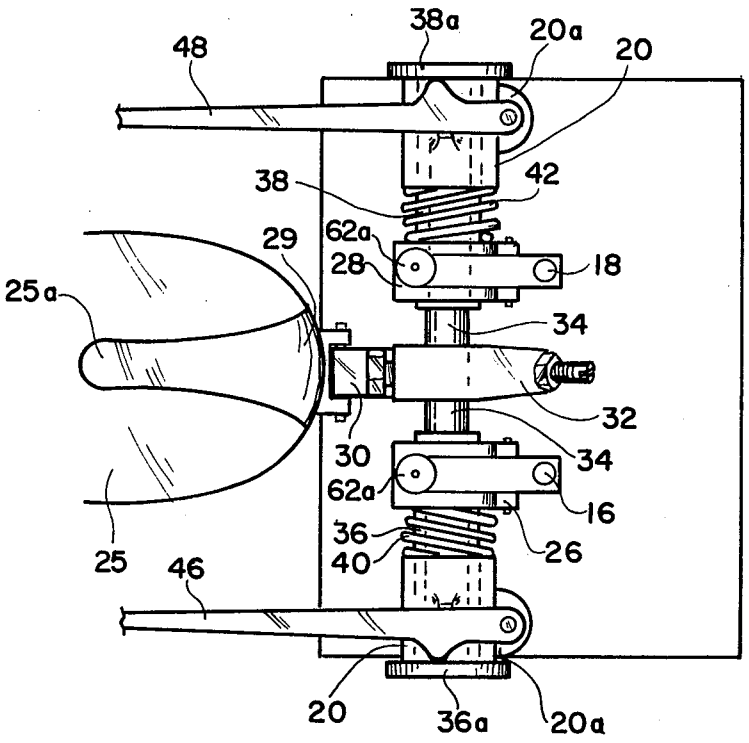
FIG. 2 is a plan view of a portion of the arrangement shown in FIG. 1, with this view revealing the laterally operative levers whereby the drummer can selectively drop out either of the beaters during a performance, and thereafter quickly restore same to an operative condition.
Figure 3A:
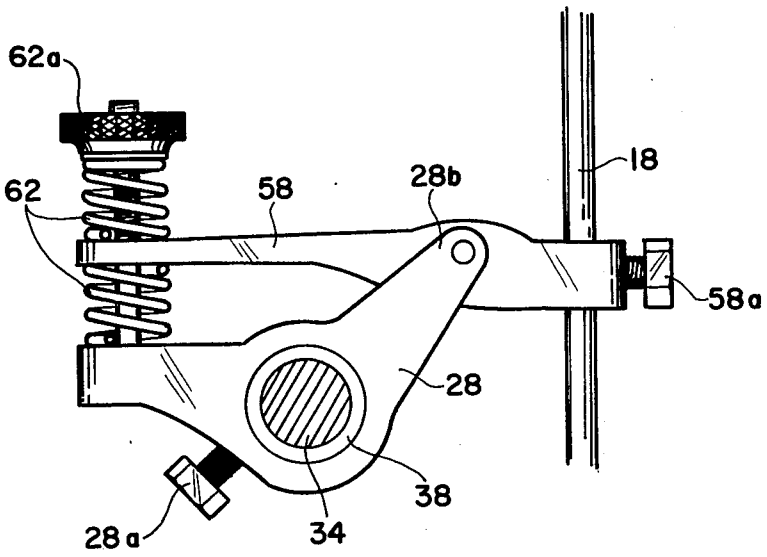
FIG. 3*a* is a fragmentary view to a larger scale, illustrating the preferred spring-type beater mounting arrangement, which permits a desirable amount of overtravel of the beater.
Figure 3:
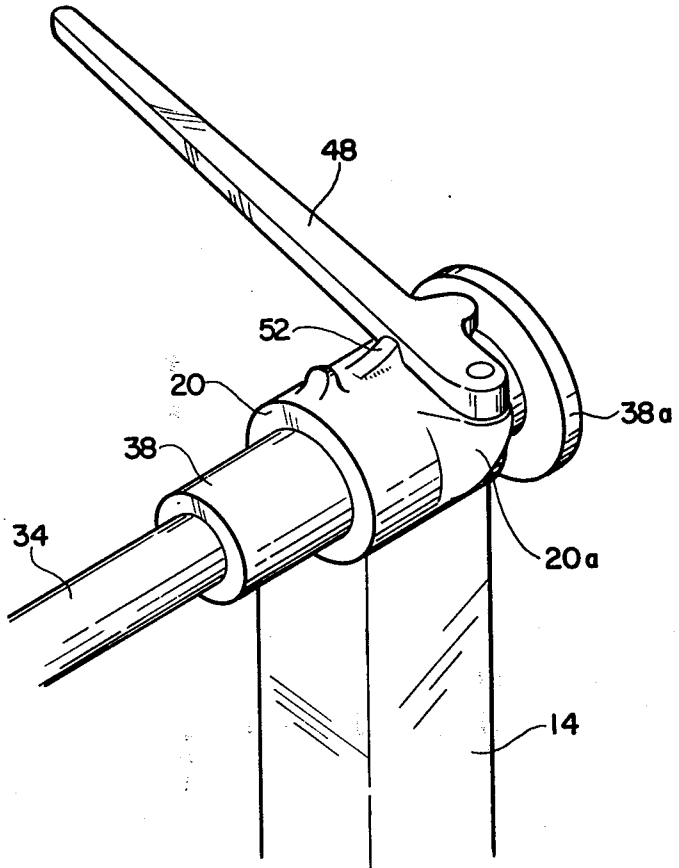
FIG. 3 is a fragmentary perspective view illustrating the manner in which one of the laterally movable levers may be maintained in the outward position.

As will be noted in FIG. 1, but in additional detail in FIGS. 2 and 3, the upper ends of upstanding members 14 are enlarged to form bosses 20, with each being provided with a central hole in order that a shaft 34 can extend between and through these supports, and be rotatable therein. Enlargements 20*a* may be provided on the bosses for a purpose subsequently set forth herein.

Figures 4, 4A:
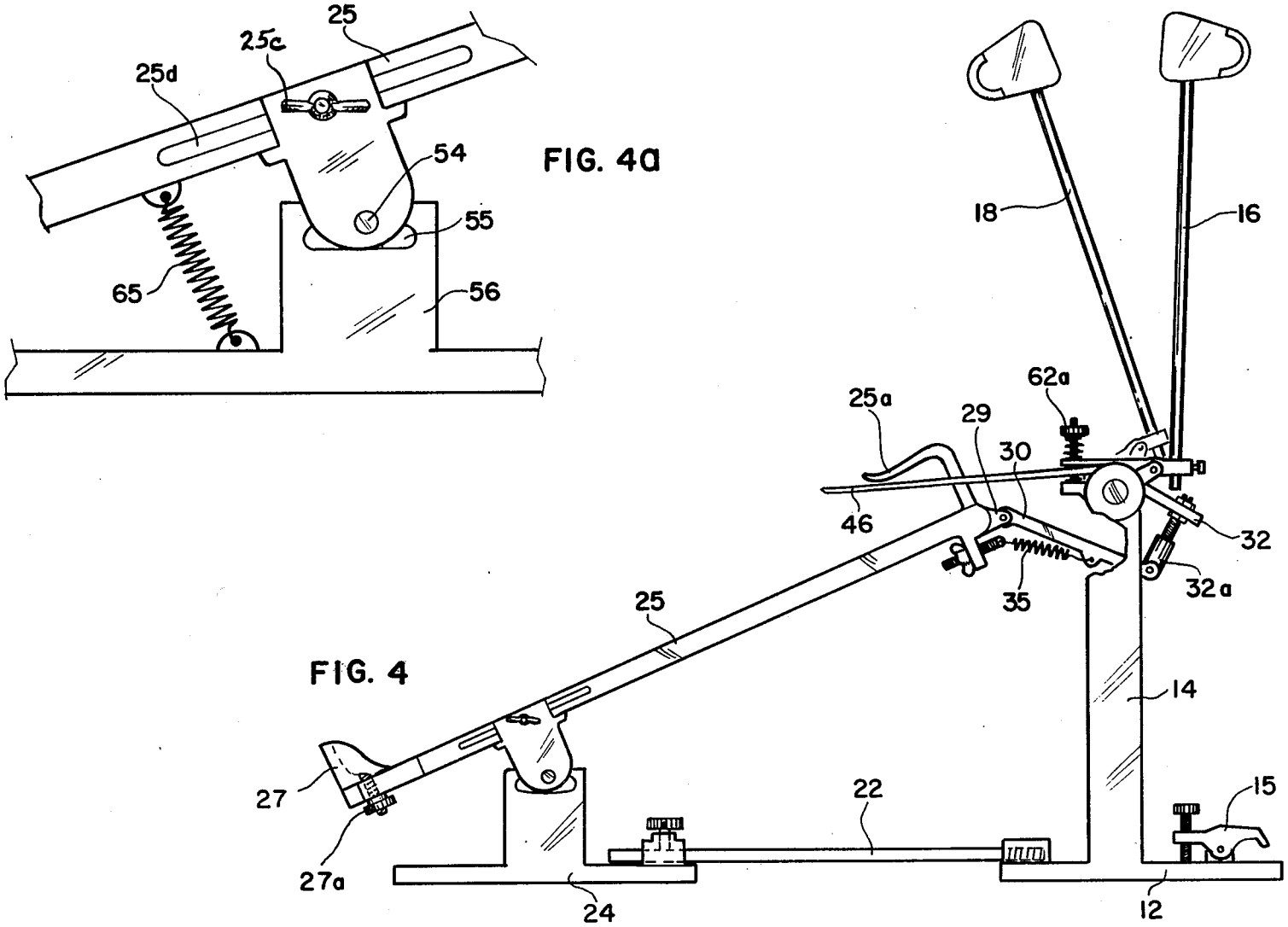
FIG. 4 is a side elevational view, with part of the support structure removed in order to reveal key portions of the linkage arrangement utilized to connect the toe portion of the foot pedal to the beaters.
FIG. 4*a* is a fragmentary view to a larger scale, illustrating the manner in which the location of the fulcrum can be altered, and depicting an alternative spring arrangement utilized for causing the return of the foot pedal.

As indicated in FIGS. 2 and 4, the toe portion 29 of the footpedal member 25 is connected by a link 30 with an offset member 32 that is bolted or otherwise clamped to a mid-portion of the shaft 34. Thus, as the drummer manipulates the pedal 25 with his foot, this causes a motion of the link 30, and the offset member 32, and therefore brings about a commensurate rotation of the shaft 34. The length of a portion of the member 32 may be selectively altered for stroke adjustment reasons, as explained hereinafter.

It is to be understood that the shaft 34 rotates first in one direction and immediately thereafter in the other direction during downward movement of the toe portion of the pedal, and then rotates in alternate directions during return movement of the pedal, and as a result of the novel construction in accordance with this invention, one or more beaters can be caused to strike the head of the adjacent drum twice per down and up cycle of the pedal. Preferably, the beaters are spaced at different distances from the drumhead, such that the drummer can achieve a "flam" or syncopation effect. For example, at rest the head of the beater 18 can be in contact with the drumhead, and the head of the beater 16 spaced say two inches therefrom. The particular action that brings about the beaters striking the drumhead in an offset relationship once as the pedal 25 moves down, and again as the pedal moves up will be explained at greater length hereinafter.

Rather than the beaters 16 and 18 each being affixed to the shaft 34, I prefer to mount each on a respective one of my novel beater mounts 26 and 28 as shown in FIGS. 1, 2, and 3*a*, with it being the purpose of such mounts to permit the beaters to move with the shaft 34, yet on occasion have a substantial amount of overtravel. These spring-type mounts will be described at greater length hereinafter in connection with FIG. 3*a*.

It is to be observed from FIGS. 2 and 2*a* that beater mounts 26 and 28 are not secured directly to shaft 34, but rather the beater mounts 26 and 28 are secured to respective sleeves 36 and 38 disposed in surrounding relation about the shaft 34 adjacent the ends thereof. The inner diameter of each sleeve is such that the shaft 34 can, on occasion, rotate freely therein, and so that relative longitudinal motion between the sleeves and shaft can take place. To this end I may choose to utilize ball bearings at certain locations in order to minimize friction.

In accordance with this invention, I spline each of shaft 34 in the manner shown in FIG. 2*a*, and construct internal teeth in the end of each sleeve, which internal teeth can mesh with the respective splines of shaft 34, such that the sleeves normally undertake all of the rotative movements of the shaft 34. The sleeves are long enough along their axes that the base portions of the beater mounts 26 and 28 can be affixed tightly yet removably to the inner ends of the sleeves 36 and 38 as shown in FIG. 2, with rotation of the shaft 34 thus causing the beaters 16 and 18 to strike the drumhead in the desired manner or sequence.

In order to afford a considerable amount of versatility to the arrangement, I provide foot-operated disconnect levers 46 and 48 as shown in FIG. 2, such that the drummer can, with a certain sidewise movement of his foot, disable either one or the other of the beaters, such that only a single beater responds to pedal movements. This selective disabling of either of the beaters is accomplished by pivotally mounting each laterally-movable lever on an enlarged boss 20*a* on the respective member, and then arranging a mid-portion of the lever to act against an enlarged sleeve end; note FIG. 2*a* with regard to this detail. The drummer, by the application of a proper amount of foot force against the lever, can cause the somewhat enlarged mid-portion of the lever to act against the enlarged end of the sleeve, such as end 38*a* in FIG. 2*a*, as to bring about longitudinal sleeve movement such that the internal teeth of the respective sleeve move out of contact with its splines. As a result, the disabled beater mount remains in a single position, despite continuing movements of the shaft 34 in rotation.

As seen in FIG. 2, a compression spring 40 surrounds sleeve 36, and compression spring 42 surrounds sleeve 38, with one end of each spring abutting the respective beater mount, and the other end of each spring abutting the respective enlarged boss 20. When a given disconnect lever has been manipulated laterally to move the internal teeth of its sleeve out of contact with the teeth of the splines of shaft 34, this brings about a substantial amount of compression of its spring. Note the compression of spring 42 in FIG. 2*a*. Such compression is sufficient to bring about a substantial amount of friction between an abutting portion of lever 48 and the enlarged end 38*a* of sleeve 38, thus holding the non-engaged beater in the selected rotational position. A stop 52 as shown in FIG. 3 prevents the spring bias from causing an immediate re-engagement of the teeth and splines.

When the drummer wishes to restore the beater, in this case beater 18, to the operative condition, he lifts the lever 48 with his foot for a sufficient distance that the lever moves above and out of contact with the stop 52. The enlarged mid-portion of lever 48 consequently moves out of contact with the end member 38*a*, and the compression spring 42 takes over, causing the internal teeth of the shaft 34, with this of course having the effect of causing the sleeve and beater 18 to again be responsive to the movements of the shaft 34. As is obvious, the same mechanization also applies to the operation of beater 16.

It should now be apparent that by using this type of construction in connection with both of the beaters, the drummer can selectively and rapidly disable either beater, and then thereafter quickly restore it to an active condition, with all of this not requiring anything more than appropriate lateral foot movements by the drummer. It is important to observe that these lateral movements do not need to adversely affect the rhythmical movements of the drummer's foot with respect to the footpedal 25.

It is to be noted that by being able to selectively disengage either one of a pair of beaters, the drummer is enabled to alternate between two different textures of beaters. For example, the beater that at a given moment strikes the drumhead first may be the hard beater, whereas the beater spaced so as to strike the drumhead an instant later may be a relatively soft beater; note FIG. 1. After performing with this arrangement for a selected period, the drummer can then disable the primary or lead beater, so that only the secondary or soft surfaced beater is for the time being activated. Then, after a brief or a lengthy interval, at a point in which the secondary beater is adjacent the drumhead, the hard beater is re-engaged by an appropriate lateral foot movement, but this time in a secondary or rearwardly offset position with respect to the soft beater; note FIG. 4. By continuing the performance, the drummer can achieve a substantially different effect than before.

Inasmuch as any change in the distance of the beaters from the drumhead will result in a change in the amount of striking power that can be applied to the drumhead by the pedal, it is desirable to be able to reposition the pedal member 25 with respect to its base on certain occasions. The preferred embodiment of a pedal arrangement involves a pedal 25 supported in an arrangement as shown in FIG. 1 with an adjustable heel member 27 utilized on the lower portion thereof. A laterally disposed pin 54 on the underside of the pedal extends through an aligned pair of slots 55 extending in a fore and aft direction, disposed in the mounting base 56. As shown in FIG. 1, a plurality of notches are formed in the upper surface of each slot, and compression spring 57 biases the lateral pin 54 into a selected aligned pair of notches. In order to modify the relationship between the pedal and the vertical uprights 14, the drummer merely depresses his foot on the pedal with particular emphasis on the heel, so as to further compress the spring 57 for a suitable distance, and then proceeds to slide the pedal member 25 and therefore the pin 54 in the desired direction in the slots. It is to be noted that the further back in the base 56 the pin 54 is moved, the less the power but the faster the action, inasmuch as the at rest angle between the pedal and the link 30 is minimized, and the beater stroke is lessened. On the other hand, the closer toward the drumhead that the pin 54 is moved, the steeper the angle between pedal and link, and the greater the excursion the beaters make with respect to the drumhead, thereby allowing for an increase in the power with which the pedal can drive the beaters.

Turning to FIG. 3*a*, I there illustrate a preferred arrangement for a beater mount, in this case beater mount 28, and as will be noted, the beater mount is secured by a set screw **28*a* to the respective sleeve, here sleeve 38, so as to be rotatable therewith at all times. As previously explained, the sleeve 38 is slidable on occasion along shaft 34**.

A clevis **28*b* is formed on an upper portion of the beater mount, in which an elongate member 58 is pivotally mounted. The shaft of beater 18 is firmly fixed in one end of the elongate member, at a location toward the drumhead with respect to the pivotal arrangement. The end of the elongate member 58 remote from the pivot is disposed between a pair of compression springs 62. In this way, the shaft of the beater and the elongate member 58 can move with its sleeve 38 and thus develop ample force for the beater head to strike the drumhead in a desirable manner. However, quite advantageously, the elongate member 58 and the beater can experience a substantial amount of overtravel on occasion, with respect to the principal portion of the beater mount, for the springs 62 are readily compressible to permit relative motion of the elongate member 58 with respect to the main portion of the beater mount. Thus, it quite correctly may be stated that the beater arms are spring mounted inasmuch as a novel spring arrangement is utilized in order to permit a significant amount of beater overtravel. Adjustment knobs 62*a*** on the beater mounts make it possible for the drummer to accomplish an effective spring adjustment, such that the different lengths and different weights of beaters used can be compensated for.

The fact that both beaters are thus mounted in such a way as to permit overtravel with respect to the base portion of their respective beater mounts is of considerable consequence to my invention, for it enables, when a strong thrust is applied, a first beater to strike the drumhead to be followed by the second, offset mounted beater striking the drumhead with a substantially harder beat an instant later. In view of the commonality of both beaters to the shaft 34, it should be noted that without the spring mounting, the second beater could not have reached the drumhead.

Figure 3C:
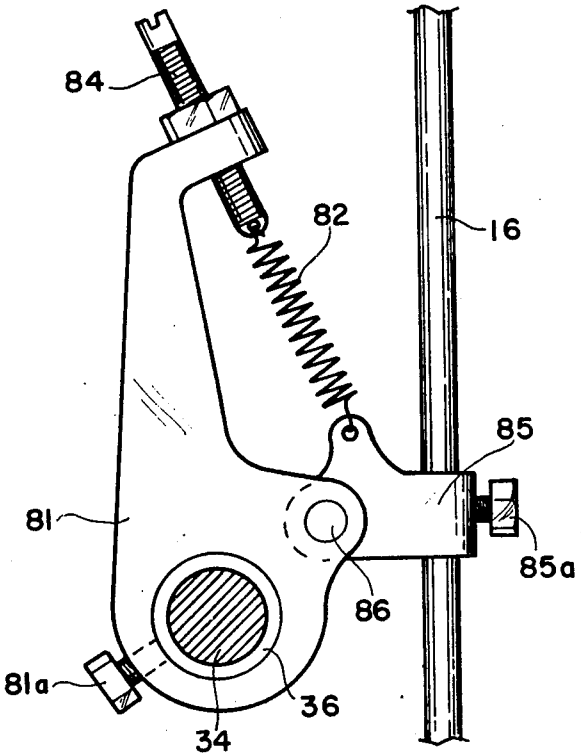
FIGS. 3*b* and 3*c* are other embodiments of spring-type beater mounts that may be utilized in order to permit a desirable amount of beater overtravel.
Figure 3B:
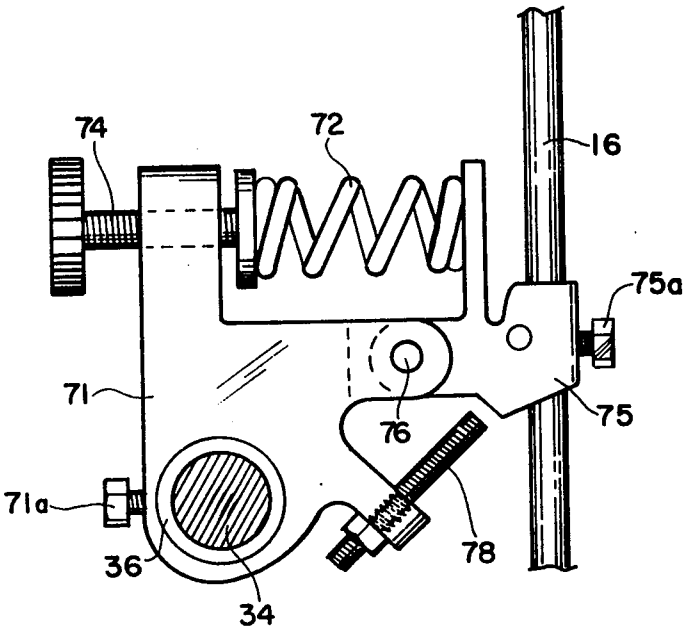

FIG. 3*b* illustrates an alternate form of beater mount, in this instance involving a base member 71 held by a set screw **71*a* in a desired relationship to sleeve 36 surrounding the shaft 34. The base member supports by means of a pin 76, a movable portion 75, with set screw 75*a* in latter member serving to support beater shaft 16 in the desired relationship. A compression spring 72 biases the movable portion 75, in this instance clockwise about the pin 76, and an elongate screw member 78 determines the normal position of the member 75. Upon the base member 71 being moved clockwise about the shaft, the beater is caused to strike the drumhead, which would be to the right with respect to the beater mount, with the spring 72** being able to compress to permit a desirable amount of travel of the beater away from the drumhead, subsequent to the striking thereof.

The amount of compression of the spring 72 can be set by turning knob 74, and the screw member 78 is held by a set screw at a length appropriate to hold the movable portion 75 in the desired relationship to the other portions of the drumbeater device and to the adjacent drumhead.

FIG. 3*c* reveals another beater mount embodiment, with base member 81 being held in a desired relationship to the sleeve member 36 by means of a set screw **81*a*. Movable portion 85 is rotatably supported by means of a pin 86 at an appropriate location on the base member 81, with portion 85 supporting the beater shaft 16 in a desired position with the aid of set screw 85*a***.

The movable portion 85 is held in an operative relationship to the base portion 81 by a tension spring 82, with a tightening means 84 enabling the amount of tension in spring 82 to be selected. As is obvious, the beater is permitted a substantial amount of overtravel inasmuch as the movable portion 85 can pivot for a considerable extent about the pivot 86 after the beater has struck the adjacent drumhead.

As an alternative to the various forms of spring type beater mounts, the shafts of the beaters 16 and 18 may be of sufficiently flexible construction as to permit a desirable amount of overtravel.

Turning now to FIG. 4, it is to be realized that a principal feature of my invention involves the fact that either or both of the beaters 16 and 18 may each strike the adjacent drumhead twice for each complete up and down cycle of the pedal 25. Typically, the beater selected as primary strikes twice per pedal cycle, with the secondary beater being controllably interspersed so as to complement with a flam or syncopation effect, the action of the first. As previously mentioned, an offset member 32 is affixed to approximately the center of the shaft 34, with the other end of member 32 being hingedly affixed to a link 30 that is in turn hingedly affixed to the toe portion 29 of the foot pedal 25. The lengths of these components are chosen such that as the user's foot causes the toe portion of the pedal to start down, the link 30 pushes against the arm 32 so as to cause the beater head (or heads) to move away from the at rest position adjacent to, or resting against, the drumhead. The motion of the beaters away from the drumhead continues until such time as the link 30 is directed almost vertically downwardly. As the link nears the latter position, the momentum of the foot and pedal will move the offset member 32 back in the opposite direction, and in doing so causing the beater to strike the drumhead with a force largely determined by the force and speed of the foot motion.

The preferred embodiment of this invention involves the use of a tension spring 35 extending from the underside of the pedal, to a location on the underside of the link 30 that is relatively near the arm 32. On the downstroke of the pedal, the spring 35 is stretched for a substantial extent, and this amounts to a force that is sufficient to bring about a return of the pedal to its original position. Of course, the pedal may be equipped with a bracket or toe portion 25*a* such that the toe of the user's shoe may be engaged. Since this latter arrangement will cause a return of the pedal to the upward position as the users foot moves up, the spring 35 in such instance may be eliminated, or both the bracket and the spring may be utilized at the same time. As will be obvious, the pedal movements positively control the positioning of the beaters, which means that the drummer has much move control over the beater action than was possible in an arrangement wherein leather members, for example represented a vital portion of the beater linkage. Because of this control, the drummer can obtain a much faster, more powerful drumbeat than was previously possible.

With regard to FIGS. 4 and 4*a*, it will there be noted that two different types of pedal return arrangements are shown, with the embodiment of FIG. 4 utilizing, as previously mentioned, a spring 35 that acts directly upon the link 30 in causing the pedal 25 to return to its upward position after being depressed, and FIG. 4*a* showing a rear spring 65 that acts upon the heel portion of a pedal member in causing the pedal to return to its upward position. Other arrangements are also possible within the spirit of this invention.

As should now be clear, I prefer to use a rocking foot pedal, one that will cause a substantially hard beater impact on the upstroke of the pedal. As is apparent from FIG. 4, the fact that the fulcrum is forward of the heel enables the drummer to control the force of the beater on the upstroke by the force he applies with his heel during the time the pedal forward of the fulcrum is moving upwardly. This factor plus of course the action of the spring 35 (or 65) causes the pedal to move upwardly and the beater to strike the drumhead, but, in addition, I may use a toe clip 25*a*, as previously mentioned, for further enabling the user to cause the drumbeater to strike the drumhead with as much force on the upstroke as is appropriate in a given instance.

It is of course to be realized that I am not to be limited to a rockable pedal, wherein the force of the heel has a contributory effect with regard to the force of the return, for the spring plus the toe clip makes possible an appropriate upward movement of the toe portion of the pedal even if the fulcrum is at the lower end of the pedal.

As will be noted from a further study of FIGS. 4 and 4*a*, a preferred embodiment of the pedal 25 includes various adjustments that may be made in the pedal so as to receive different foot lengths, and so as to make it possible for the location on the pedal of the fulcrum to be selectively altered. As noted in FIG. 4, the heel member 27 may be provided with an adjustment device 27*a* making it possible for this member to be shifted longitudinally, thereby enabling foot lengths of various sizes to be accomodated. As shown more particularly in FIG. 4*a*, a wingnut 25*c* may be provided on each side of the pedal, with the loosening of such making it possible for the pedal 25 to be slid with respect to the fulcrum pin 54. This type of motion is of course made possible by the provision of slots 25*d* along each side of the pedal, in which bolts (not shown) are disposed. This adjustment is necessary in order that the pedal will be more adaptable to feet of varying sizes, and also in order that the user might easily adjust the amount of heel-thrust that the pedal will impart to the beaters.

In addition, I preferably provide a screw adjustment 32*a* in one arm of the offset member 32 such that the distance between the pivot point of the members 30, 32 and the shaft 34 can be selectively adjustable, so that the action desired by a given drummer can be obtained. Locknuts are utilized to prevent slippage of the screw adjustment away from a selected position.

Figure 5A:
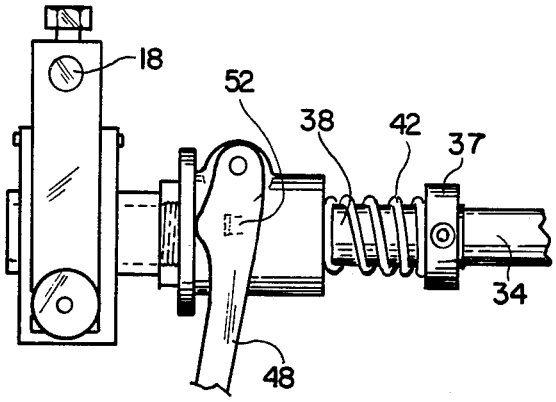
FIG. 5*a* is a fragmentary view to a slightly larger scale of a portion of the embodiment of FIG. 5, illustrating certain components in greater detail.
Figure 5:
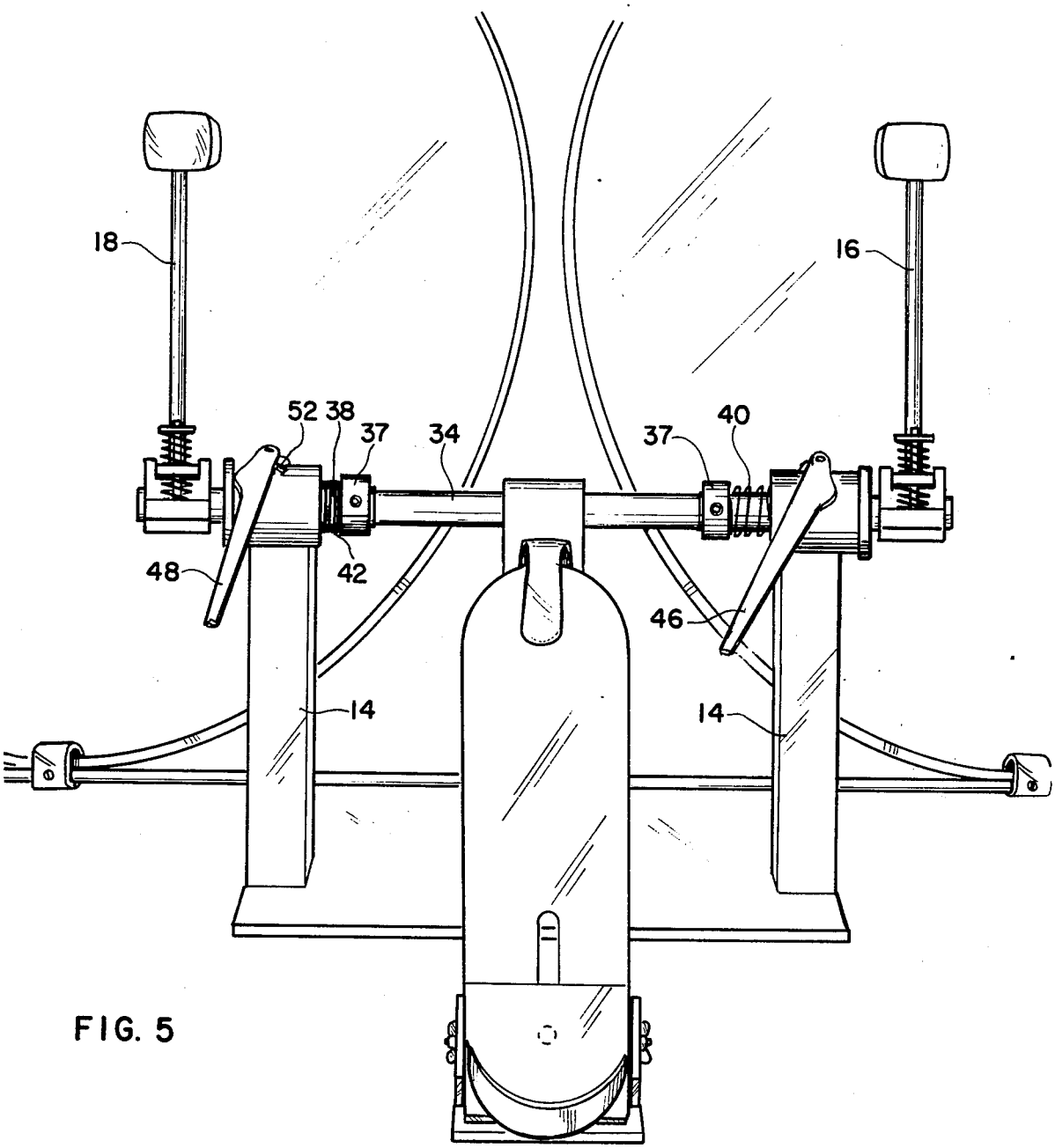
FIG. 5 is an embodiment of my invention in which the location of the beaters on the oscillatory shaft has been altered such that each beater may strike a separate drumhead.

Turning to FIG. 5, it will be seen in this embodiment that the same basic construction of the upstanding support members 14 and the footpedal assembly 24 is utilized, except that in this instance, I have mounted the beaters 16 and 18 on the external ends of the oscillatory shaft 34. In accordance with this arrangement, the heads of two separate drums may be selectively struck by the beaters, utilizing the "Flam" effect rather than the beaters being confined to a single drum, and also in this instance, the beaters may be selectively disconnected by the drummer pushing against the appropriate laterally-movable lever 46 or 48, in the manner previously described.

In the fragmentary view depicted as FIG. 5*a*, the use of compression spring 42 on the sleeve 38 is revealed, such being utilized in order that a prompt return of beater 18 to the active position is automatically accomplished as soon as the drummer has lifted the laterally movable lever over the stop 52. A collar 37 is mounted on each of the sleeves 36 and 38 at locations appropriate to cause the amount spring compression desired when the respective lateral lever has been moved in the beater-disconnect direction.

As should now be apparent, by the use of a drum beater in which my novel, spring loaded beaters are utilized, the drummer is enabled to take advantage of the fact that the stronger the force he applies to the foot pedal, the greater the arc of travel of the beater. Advantageously, the drummer can position the beater for speed, where the beater basically operates close to the drumhead, but at such time as he applies greater force to the pedal, the distance the beater travels with respect to the drumhead lengthens, with this increase in arc of travel of course taking place as a result of the thrust applied, with accompanying increase in intensity.

It is important to note that my device does not have a neutral position of the beaters wherein spring means are responsible for returning the beaters to such position, for the pedal of my device asserts a positive control over the beaters at all times.

I claim:

1. A drum beater device having a beater adapted to strike an adjacent drumhead in response to movements of a foot-operated pedal, said drum beater device comprising a spring mounted beater arm supporting a beater head, said beater arm being mounted to swing in an arc about a shaft arranged to undertake oscillatory type rotational movements, an elongate arm attached to said shaft in an offset relation thereto, a foot pedal having a pivotal support about which it is rockable so as to bring about up and down movements of a toe portion of said pedal, connecting link means of rigid construction pivotally connecting said toe portion of said foot pedal to said elongate arm, such that up and down movements of said toe portion cause said connecting link and said elongate arm to move responsively and thus cause said shaft to oscillate rotationally, and means interconnecting said shaft and said beater arm such that said beater head is caused by such shaft oscillations to strike an adjacent drumhead, said pedal being shiftable longitudinally by foot pressure toward or away from said rotatable shaft at the behest of the drummer, so as to accomplish an actual relocation of the pivotal connection at said toe portion, thus to change beater excursion and affording the drummer direct control over the force and speed of the drumbeat.

2. The drum beater device as defined in claim 1 in which a spring biased pedal is utilized, which pedal serves to move the beater into a drumhead-striking position during the upstroke of the pedal.

3. The drum beater device as defined in claim 1 in which a pair of spring mounted beaters are mountable upon said shaft, means for adjusting one beater to be slightly closer to the drumhead than the other beater, thus to enable the beaters to strike the drumhead in an offset relationship.

4. The drum beater device as defined in claim 3 in which a disconnect means is provided whereby at least one of said beaters can be disconnected such that it no longer moves in response to movements of said shaft, said disconnect means also enabling the disconnected beater to be rapidly and selectively reconnected in a desired rhythmical relationship to the other beater.

5. The drumbeater device as defined in claim 3 in which said beaters are mounted on the extreme outer ends of said rotatable shaft, so that the heads of separate drums may be struck by the beaters.

6. A double acting drum beater device having a beater adapted to strike an adjacent drumhead once for each downward movement of a foot operated pedal, and then a second time under direct control of the foot pedal during subsequent upward return movement of the pedal, said drum beater device comprising at least one beater arm arranged to swing in an arc about a rotatable axis, said rotatable axis being defined by a shaft supported by mounting means, which shaft is arranged to undertake oscillatory type rotational movements, an arm affixed to said shaft in an offset relation to said shaft, a pivotally mounted foot pedal operatively disposed adjacent said mounting means and having up and down movements in response to foot motion, a connecting link of rigid construction pivotally connected at its one end to a toe portion of said foot pedal, and pivotally connected at its other end to the end of said offset arm, said foot pedal, when its toe portion is in an upward position, having an angular relationship to the plane of said link, with the end of the link connected to the foot pedal being higher than the end connected to said offset arm, said foot pedal, when pushed downwardly, moving with respect to said link such that the planes of the pedal and link are momentarily in alignment, with the pedal and link thereafter moving to a position below the aligned positon, said pedal, acting through said rigid link, bringing about shaft oscillation and therefore the beater striking the drumhead during each downstroke as well as during each upstroke of said pedal, and in doing so moving through momentary positions of alignment with said link during motion in each direction.

7. The double acting drum beater device as defined in claim 6 in which a spring biased pedal is utilized, which pedal serves to move at least one beater into a drumhead-striking position during the upstroke of the pedal.

8. The double acting drum beater device as defined in claim 7 in which return of said pedal in the upward direction is brought about by a spring means operatively attached adjacent the heel portion of said pedal.

9. The double acting drum beater device as defined in claim 7 in which return of said pedal in the upward direction is brought about by a spring means operatively attached adjacent the toe portion of said pedal.

10. The double acting drum beater device as defined in claim 6 in which the pivot point of the pedal is forward of the heel portion of the pedal, thus enabling a drummer to bring about a return stroke of the pedal by means of heel pressure.

11. The double acting drum beater device as defined in claim 6 in which said pedal is a rockable pedal pivotally supported in a base, said pivotal support being shiftable toward or away from said rotatable shaft at the behest of the drummer, in order that he will have control over the force and speed of the drumbeat.

12. The double acting drum beater device as defined in claim 6 in which a pair of beaters are mountable upon said shaft, at least one of which is flexibly mounted with respect to said shaft, means for adjusting one beater to be closer to the drumhead than the other beater, thus to enable the beaters to strike the drumhead in an offset relationship.

13. The double acting drum beater device as defined in claim 12 in which a disconnect means is provided whereby at least one of said beaters can be disconnected such that it no longer moves in response to movements of said shaft, said disconnect means also enabling the disconnected beater to be rapidly and selectively reconnected in a desired rhythmical relationship to the other beater.

14. The double acting drumbeater device as defined in claim 6 in which said beaters are mounted on the extreme outer ends of said rotatable shaft, so that the heads of separate drums may be struck by the beaters.

15. A double acting drum beater device having a minimum number of functioning parts and utilizing beaters adapted to strike an adjacent drumhead once for each downward movement of a foot-operated pedal, and then a second time during the subsequent upward return movement of the pedal, said drum beater device comprising a pair of essentially parallel beaters each arranged to swing in an arc about a rotatable axis, said rotatable axis being defined by a shaft supported by mounting means, which shaft is arranged to undertake oscillatory type movements about its longitudinal axis, an arm attached to said shaft in an offset relation thereto, a foot pedal mounted adjacent said mounting means and having up and down operative movements, connecting link means of rigid construction pivotally connected to a toe portion of said foot pedal and pivotally connected to said offset arm, such that up and down movements of the toe portion of said pedal cause, through the dual pivot arrangement, said connecting link and said arm to move responsively and thus cause said shaft to oscillate in a rotary manner, said shaft rotating in a first direction and then in the opposite direction about its longitudinal axis during downward movement of said pedal, and thereafter rotating in both directions during the ensuing upward movement of the pedal, and means interconnecting said shaft and said beaters such that each of said beaters is caused by such shaft oscillations to strike an adjacent drumhead twice for each up-down cycle of said pedal.

16. The double acting drum beater device as defined in claim 15 in which a spring loaded pedal is utilized, which pedal serves to move at least one beater into the operative position on the upstroke of the pedal.

17. The double acting drum beater device as defined in claim 15 in which return of said pedal in the upward direction is brought about by a spring means operatively attached adjacent the heel portion of said pedal.

18. The double acting drum beater device, as defined in claim 15, in which said pedal is pivotally supported in a base, said pivotal support being shiftable toward or away from said rotatable shaft at the behest of the user, in order that he will have some control over the force and speed of the drumbeat.

19. The double acting drum beater device as defined in claim 15 in which means are provided for adjusting one of said beaters to be closer to the drumhead than the other beater, at least one of said beaters being flexibly mounted with respect to said shaft, thus to enable the beaters to strike the drumhead in an offset relationship.

20. The double acting drum beater device as defined in claim 19 in which disconnect means are provided whereby at least one of said beaters can be disconnected such that it no longer moves in response to movements of said shaft, said disconnect means also enabling the disconnected beater to be rapidly and selectively reconnected in a desired rhythmical relationship to the other beater.

21. A drumbeater device having a beater having a minimum number of functioning parts and adapted to strike an adjacent drumhead in response to movements of a foot operated pedal, said drumbeater device comprising a beater arm mounted to swing in an arc about a rotatable shaft arranged to undertake oscillatory type rotary movements, a foot pedal having up and down operative movements, an arm attached to said shaft in an offset relation thereto, connecting link means pivotally connected to a toe portion of said foot pedal and pivotally connected to said offset arm such that up and down movements of the toe portion of the pedal cause, through the dual pivot arrangement, said connecting link and said arm to move responsively and thus cause said shaft to oscillate, said beater arm being mounted on a sleeve disposed in surrounding relation around said shaft, and that is longitudinally slidable on said shaft between first and second positions, said sleeve, when in the first of said positions, being movable with said shaft during its oscillatory movements, and when in the second position on said shaft, being non-movable insofar as oscillatory type motions are concerned, said beater arm thus being caused to strike the adjacent drumhead in response to foot pedal movements only when said sleeve is in said first position.

22. The drumbeater device as defined in claim 21 in which a laterally movable lever is positioned adjacent said foot pedal, with such lever being connected to effect the longitudinal movements of said sleeve on said shaft, and with said lever able to be operated by lateral movements of the drummer's foot.

23. The drumbeater device as defined in claim 21 wherein said beater arm is spring mounted, such that the beater may undertake a certain amount of overtravel with respect to oscillatory movements of said sleeve, with such spring mounting enabling the beater to travel in a wider arc as the force of the user's foot increases.

24. A double acting drum beater device utilizing beaters adapted to strike an adjacent drumhead once for each downward movement of a foot-operated pedal, and then a second time during the subsequent upward return movement of the pedal, said drum beater device comprising a pair of beaters arranged to swing in an arc about a rotatable axis, said axis being defined by a shaft supported by mounting means, which shaft is arranged to undertake oscillatory type rotary movements about its longitudinal axis, at least one of said beaters being supported by a mount allowing for flexibility, the mount for each beater being secured to a separate sleeve disposed on said shaft, each of said sleeves being slidable along said shaft between operative and inoperative positions at the behest of an operator, with each sleeve being rotatable with said shaft only when it is in the operative position, a foot pedal mounted adjacent said mounting means and having up and down operative movements, an arm attached to said shaft in an offset relation thereto, connecting link means of rigid construction connecting a toe portion of said foot pedal to said arm, such that up and down movements of the toe portion of said pedal cause said connecting link and said arm to move responsively and thus cause said shaft to oscillate, said shaft rotating in a first direction and then in the opposite direction about its longitudinal axis during downward movement of said pedal, and thereafter rotating in both directions during the ensuing upward movement of the pedal, each of said beaters being caused by such shaft oscillations to strike an adjacent drumhead twice for each up-down cycle of said pedal when said sleeves are in said operative positions.

25. The double acting drum beater as defined in claim 24 in which the movement of said sleeves between said operative and inoperative positions is controlled by separate laterally operable foot levers disposed adjacent said foot pedal.

26. The double acting drum beater device as defined in claim 24 in which said pedal is a rockable pedal pivotedly supported in a base, said pivotal support being shiftable toward or away from said rotatable shaft at the behest of the drummer, in order that he will have control over the force and speed of the drumbeat.

27. The double acting drum beater device as defined in claim 24 in which means are provided for adjusting one beater to be initially closer to the drumhead than the other beater, thus to enable the beaters to strike the drumhead in an offset relationship.

28. The double acting drumbeater device as defined in claim 24 in which said beaters are mounted on the extreme outer ends of said rotatable shaft, so that the heads of separate drums may be struck by the beaters.

29. A double acting drum beater device having a beater adapted to strike an adjacent drumhead once for each downward movement of a foot operated pedal, and then a second time under direct control of the foot pedal during subsequent upward return movement of the pedal, said drum beater device comprising at least one beater arm arranged to swing in an arc about a rotatable axis, said rotatable axis being defined by a shaft supported by mounting means, which shaft is arranged to undertake oscillatory type rotational movements in response to foot pedal movements, a flexible spring-biased beater mount effectively mounted on said shaft so as to rotate therewith, a portion of said beater mount forming a support for said beater arm, an elongate arm affixed to a mid portion of said shaft in an offset relation thereto, said foot pedal having a pivotal support about which it is rockable so as to bring about up and down movements of a toe portion of said pedal, connecting link means of rigid construction pivotally connecting said toe portion of said foot pedal to said elongate arm, such that up and down movements of said toe portion cause said connecting link and said elongate arm to move responsively and thus to cause said shaft to oscillate rotationally, the flexible character of said beater mount permitting a controlled amount of overtravel of said shaft after said beater has struck the adjacent drumhead, and means for adjusting the strength of the spring bias of said beater mount.

30. A double acting drum beater device having a beater adapted to strike an adjacent drumhead once for each downward movement of a foot operated pedal, and then a second time under direct control of the foot pedal during subsequent upward return movement of the pedal, said drum beater device comprising at least one beater arm arranged to swing in an arc about a rotatable axis, said rotatable axis being defined by a shaft supported by mounting means, which shaft is arranged to undertake oscillatory type rotational movements in response to foot pedal movements, a beater mount effectively mounted on said shaft so as to rotate therewith, said beater mount including an elongate member pinned to the mount, the relationship between beater mount and elongate member being movable and directly influenced by spring means interconnecting same, said elongate member, at a location remote from the pin connection to said beater mount, forming a support for said beater arm, an elongate arm affixed to a mid portion of said shaft in an offset relation thereto, said foot pedal having a pivotal support about which it is rockable so as to bring about up and down movements of a toe portion of said pedal, connecting link means of rigid construction pivotally connecting said toe portion of said foot pedal to said elongate arm, such that up and down movements of said toe portion cause said connecting link and said elongate arm to move responsively and thus to cause said shaft to oscillate rotationally, said spring means interconnecting said beater mount and elongate member permitting a controlled amount of overtravel of said shaft after said beater has struck the adjacent drumhead.

31. The double acting drum beater device as defined in claim 30 in which a pair of beater mounts are used, and means are provided such that one of said beater mounts can be selectively rendered inoperative, and when desired, thereafter quickly restored to use.

32. The double acting drum beater device as defined in claim 30 in which spring adjustment means are provided for altering the force of said spring means interconnecting said elongate member and beater mount, such that the amount of overtravel can be regulated.

33. The double acting drum beater device as recited in claim 30 in which said foot pedal has a pivotal support, which pivotal support can be moved at the behest of the drummer either toward or away from said shaft in order that he can select the force and speed of the drumbeat.

* * * * *